US008118306B2

(12) United States Patent
Kean

(10) Patent No.: US 8,118,306 B2
(45) Date of Patent: Feb. 21, 2012

(54) THERAPY GAMES

(76) Inventor: Denise Kean, Dallas, OR (US)

( * ) Notice: Subject to any disclaimer, the term of this patent is extended or adjusted under 35 U.S.C. 154(b) by 16 days.

(21) Appl. No.: 12/408,556

(22) Filed: Mar. 20, 2009

(65) Prior Publication Data

US 2009/0243214 A1 Oct. 1, 2009

Related U.S. Application Data

(60) Provisional application No. 61/070,824, filed on Mar. 26, 2008.

(51) Int. Cl.
*A63F 3/00* (2006.01)

(52) U.S. Cl. ..... 273/239; 273/288

(58) Field of Classification Search ..... 273/239, 273/288, 289, 290, 291
See application file for complete search history.

(56) References Cited

U.S. PATENT DOCUMENTS

| | | | | | |
|---|---|---|---|---|---|
| 3,684,288 | A | * | 8/1972 | Grace | 273/239 |
| 4,083,564 | A | * | 4/1978 | Matsumoto | 273/239 |
| 4,275,887 | A | | 6/1981 | Tateyama | |
| 4,299,389 | A | | 11/1981 | Miolo | |
| 4,395,043 | A | * | 7/1983 | Gargione | 273/239 |
| 4,398,893 | A | * | 8/1983 | Johns | 434/305 |
| 4,861,039 | A | | 8/1989 | Phillips et al. | |
| 5,005,841 | A | | 4/1991 | Klick | |
| 5,016,888 | A | | 5/1991 | Huston et al. | |
| 5,040,800 | A | | 8/1991 | Ulan | |
| 5,228,699 | A | | 7/1993 | Ludwick et al. | |
| 5,478,085 | A | | 12/1995 | Canner et al. | |
| 5,503,400 | A | | 4/1996 | Silva | |
| 5,520,396 | A | * | 5/1996 | Therrien | 273/288 |
| 5,727,787 | A | | 3/1998 | Salley | |
| 5,997,309 | A | * | 12/1999 | Metheny et al. | 434/409 |
| 6,293,550 | B1 | | 9/2001 | Zeitlin | |
| 6,345,821 | B1 | * | 2/2002 | Labrot | 273/236 |
| 6,402,144 | B1 | * | 6/2002 | Ekberg | 273/239 |
| 6,431,548 | B1 | | 8/2002 | Voigt et al. | |
| 6,945,785 | B2 | * | 9/2005 | Sohl et al. | 434/408 |
| 7,229,073 | B2 | | 6/2007 | David | |
| 7,287,751 | B2 | * | 10/2007 | Webber, Jr. | 273/239 |
| 7,396,014 | B2 | * | 7/2008 | Jenkins | 273/242 |
| 7,866,074 | B2 | * | 1/2011 | McComb et al. | 40/606.01 |
| 2004/0110032 | A1 | * | 6/2004 | Staadecker et al. | 428/692 |
| 2005/0093237 | A1 | * | 5/2005 | Bowling | 273/255 |
| 2006/0119039 | A1 | * | 6/2006 | Reed et al. | 273/236 |

OTHER PUBLICATIONS

Abilitations, MagneticMovers, Guide to Accompany Item# 193004, May 30, 2007, USA.

* cited by examiner

*Primary Examiner* — Vishu K. Mendiratta

(57) ABSTRACT

The present invention includes at least one magnet attractant dry erase type board, a game board that may be rolled up for easy storage, and a unique game piece containing a hollow substantially transparent body with a top end and bottom end. The game piece may comprise a cap that attaches to the top end of the game piece body and a magnet that attaches to the bottom end of the game piece body. An image paper can be rolled up and placed inside the game piece body. This image paper may change the appearance of the game piece depending on the printing on the image paper.

13 Claims, 2 Drawing Sheets

THERAPY GAMES

CROSS-REFERENCE TO RELATED APPLICATIONS

This application contains disclosure from and claims the benefit under Title 35, United States Code, §119(e) of the following U.S. Provisional Application: U.S. Provisional Application Ser. No. 61/070,824 Filed Mar. 26, 2008 entitled THERAPY GAMES.

FIELD OF INVENTION

Apparatus used to properly display and play board games for therapeutic use by impaired individuals.

BACKGROUND OF THE INVENTION

Traditional board games such as chess and checkers have been around for over a thousand years and are well known in the art. Numerous retail versions are still being sold, yet a vast majority of these retail versions contain boards no larger than 20 square inches and small playing pieces that require fine fingertip to thumb coordination. Furthermore, most of this prior art contains cardboard boards used on table tops where the board sits horizontally and the game pieces are susceptible to unintentional movement. For the general public, these traditional styles of board games are sufficient, but for the handicapped users, these games become too challenging to play and to maneuver.

Many inventions such as U.S. Pat. Nos. 6,431,548, 5,727,787, 5478,085 and 4,275,887 deviate from the standard cardboard board games by utilizing magnets both in the playing piece and the board itself. Although this deviation prevents the pieces from being moved unintentionally, the playing pieces remain unaltered and the game boards remain diminutive in size. In fact, many inventions such as those shown in U.S. Pat. Nos. 6,293,550, 5,228,699, 5,016,888, 5,005,841, 4,861,039 and 4,299,389 teach toward magnetic board games that are unique due to their smaller sizes and ability to be used during travel. None of the prior art teaches of a board game designed for handicapped players with limited coordination or mobility and in fact the prior art teaches away from such novelty.

U.S. Pat. Nos. 5,503,400 and 5,040,800 teach of vertical chess boards utilizing magnets. Although these board games provide better visibility for overseers, they are not designed for handicapped users. Their playing pieces remain small and the size of the boards is unchangeable.

U.S. Pat. No. 7,229,073 teaches of a magnetized dry erase board that may be a good starting point for a board large enough for handicapped users to access but this invention fails to address board games in general.

Although the above prior art may fulfill most of its desired intentions, a need still exists for board games that allow a large vertical playing surface. Further need exists for a system where the playing pieces are larger but can still be attached to a vertical board with ease. And need exists for the playing pieces to be multifunctional and for the game board to be exchangeable and positioned at varying heights and angles. In summary there is a great need for a flexible alternative to provide therapeutic stimulation to impaired or handicapped individuals by allowing them to play simple board, card and domino games in an environment that is better suited for those individuals.

SUMMARY

The present invention may be played on at least one magnet attractant dry erase type board, which is inexpensive, compared to imprinting or enameling games on individual large magnet attractant surfaces. Having a dry erase board for drawing, matching, and writing has many secondary beneficial applications as well. The present invention also contains a game board that may be rolled up for easy storage or hung on a stand. There are many game boards possible, as alternate roll up boards may be used, or game boards may be drawn onto the dry erase board. The game board can be attached to the magnet attractant dry erase board in any means including magnets, hooks or tape. The invention further consists of a unique game piece containing a hollow substantially transparent body with a top end and bottom end. The game piece may consist of a cap that attaches to the top end of the transparent hollow body and in the preferred embodiment, a magnet cup assembly comprising a metallic metal cup which contains and protects the magnet, is riveted to the bottom end of the significantly transparent hollow body. A magnetic cup assembly is often preferable to better hold a magnet and to protect the magnet from damage. An image paper then can be placed inside the substantially transparent body. This image paper can change the entire appearance of the game piece depending on what is printed on the image paper. Because this game is meant to be played by handicapped individuals, game pieces are preferably of a substantial size, and an optional game piece pickup stick may be utilized wherein the pickup stick will have a magnetic or magnet—attractant tip where users with limited mobility can pickup fallen game pieces.

BRIEF DESCRIPTION OF THE DRAWINGS

The above description and other objects, advantages, and features of the present embodiment will be more fully understood and appreciated by reference to the specification and accompanying drawings, wherein.

DETAILED DISCUSSION OF THE PREFERRED EMBODIMENTS

Figure 1:
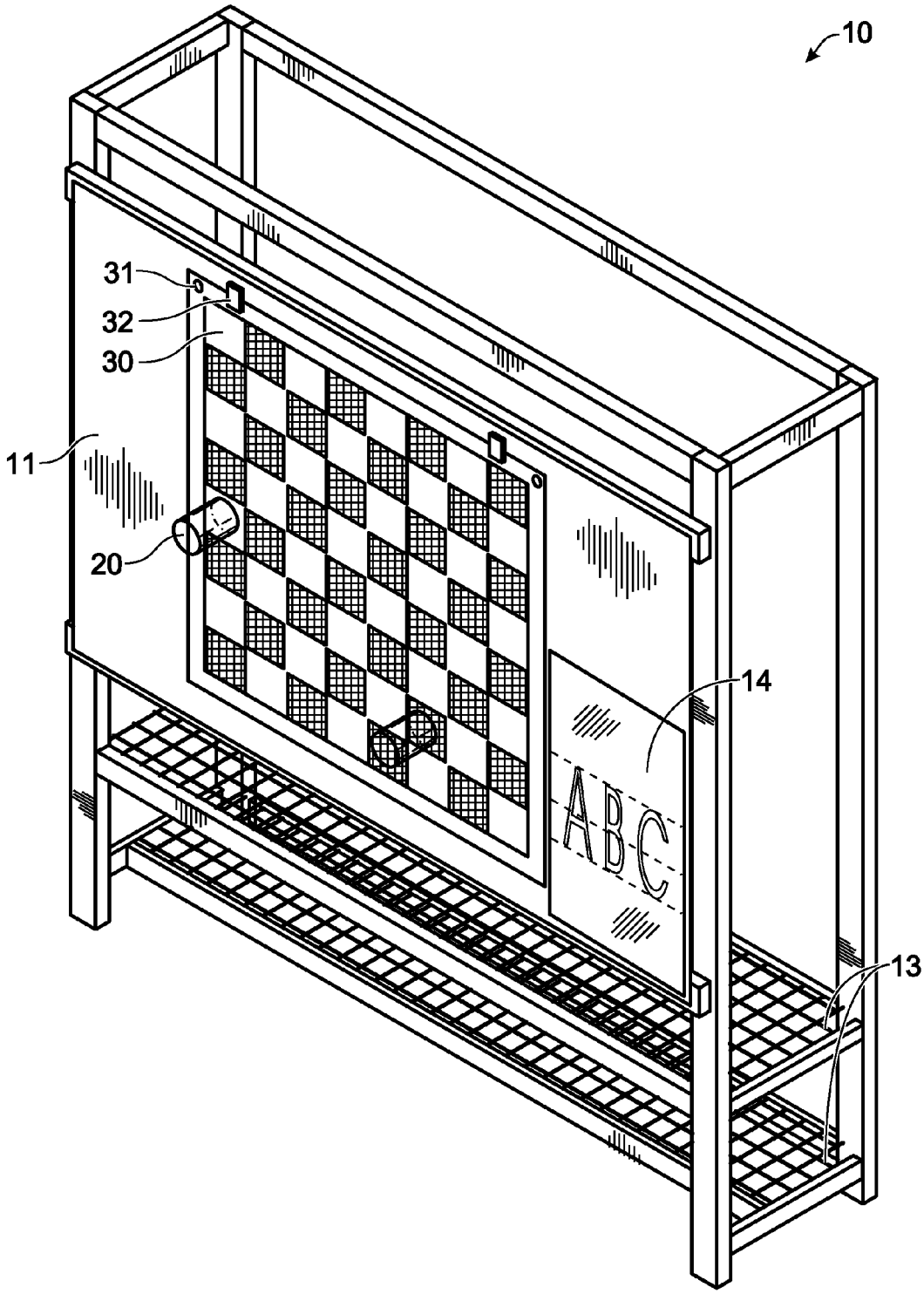
FIG. 1 is a front elevation view of the preferred embodiment of the present invention.

FIG. 1 shows the preferred embodiment of the present invention. The game board 30 is preferably larger than standard game boards and may be played on a large vertical or semi-vertical magnet attractant surface such as a dry erase board 11. The game board 30 in this preferred embodiment is made of a vinyl material and has a size ranging from 22 inches square to 44 inches square. The magnet attractant dry erase board 11 is preferably of a size in the area of 4 ft×6 ft which is large enough to allow for people of many disabilities to have the access and ability to play simple board games. The magnet attractant dry erase board 11 in the preferred embodiment is placed on a stand 10. The stand 10 has wire shelving support 13 which may be used to store unused game pieces and game boards. The game boards may also be hung on rod near the top of the stand, behind dry erase board. The present invention may also contain at least one tracing sheet 14 attached to the base of the magnet attractant dry erase board 11 with an attachment means such as a piano hinge. In the preferred embodiment, the tracing sheet 14 is made of Lexan and is of a size in the area of 2 ft high by 6 ft wide. This tracing sheet 14 allows a teacher or therapist to put written material or pictures behind the tracing sheet 14 and utilize it to teach reading & writing to handicapped students by requiring the student to trace a word or picture.

Figure 2:
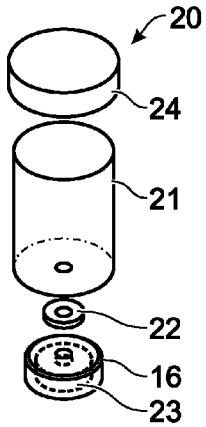
FIG. 2 is an exploded view of the preferred embodiment of the playing piece.
Figure 3:
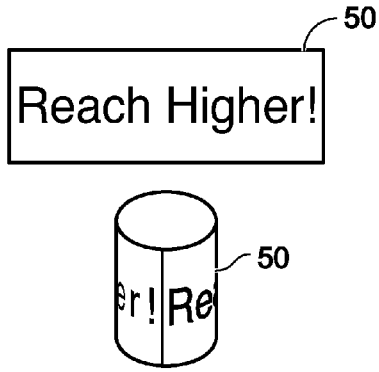
FIG. 3 is a view of the flat and rolled up image paper in the preferred embodiment.

FIG. 2 shows the preferred embodiment of one of the large playing pieces 20. The playing piece 20 consists of a hollow substantially transparent cylinder body 21. On the top end of the cylinder body 21 contains a cap 24. The cap can be screwed on the cylinder body 21. The playing piece 20 also preferably contains a magnet cup assembly 26 and a magnet 23 that is secured by a rivet to the bottom end of the cylinder body 21. This magnet cup assembly 26 may partially or complete cover the magnet 23 and prevents magnet 23 from damage when the playing piece 20 is accidentally dropped on the floor. A washer 22 may be used to promoting a flush connection between the hollow substantially transparent body 21 and the magnet 23. In the preferred embodiment the magnet 23 has around 12 lbs of pull. In the preferred embodiment the playing piece 20 has a 1.25 inch diameter and may be 5 inches in length. The cylinder body 21 and the cap 24 may be made of plastic to keep the weight of the game piece to a minimum. The larger size of the playing piece 20 allows handicapped users to easily grasp and positions the pieces.

The cap 24 may play an important roll in identifying the pieces. If the game is checkers, the caps simply have to be different colors so that the players can tell which pieces are theirs. If the game changes and new game pieces are need, the user can simply change the caps 24 to fit the game. Another unique element of the present game piece 20 is the substantially transparent cylinder body 21. The cylinder body 21 allows an image paper 50 to be rolled up and placed inside the cylinder body 21 of the game piece 20. This image paper 50 may be of an inspirational or motivational nature to inspire confidence and act as an additional therapy factor. The image paper 50 may also contain phrases or therapy terms such as "Believe in Yourself" or "Reach Higher."

Figure 4:
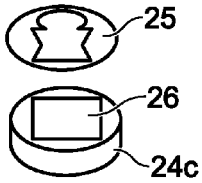
FIG. 4 is another alterative view of the playing piece.

FIG. 4 shows an alternative embodiment of a game piece 20*c*. The cap 24*c* has a magnetic tape 26 on top. Additional laminated cap covers 25 with magnets or magnet attractants can be placed on top of the cap 24*c* to turn the game piece 20 into a different game piece. One example would be "K" for "King" in checkers game or other symbols necessary to play Chess.

Figure 5:
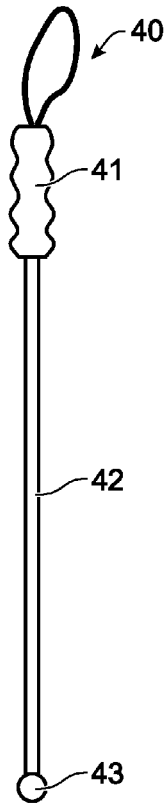
FIG. 5 is a prospective view of the pickup stick.

FIG. 5 shows a pickup stick 40 which contains a shaft 42 that may be adjustable in length and a magnetic or magnet attractant tip 43. This pickup stick 40 can assist in picking up fallen game pieces for movement impaired players.

Figure 6:
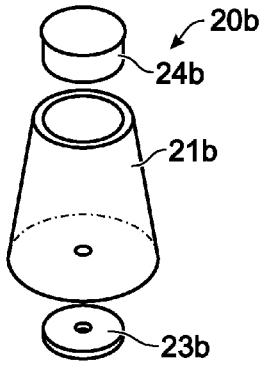
FIG. 6 is another alterative view of the playing piece.

FIG. 6 shows another alternative embodiment with a game piece 20*b* where the substantially transparent body 21*b* is cone shaped. It is disclosed that the shape of the game piece is not limited to FIGS. 2 and 6. Other shapes such as peg, golf T, rectangle, square tube, drawer knob with flat base etc can be utilized and will fall within the scope of this invention.

In the preferred embodiment, additional large playing card pieces and large domino pieces made with magnetic backing may also be used either in conjunction with the game board or the magnet attractant dry erase board. Alternatively, the playing card or domino piece can also be affixed to the cap 24 of the game piece 20.

The present invention as disclosed above serves many purposes, especially when done in a vertical orientation. The game may be used for educational, social, cognitive skill building, attention to task skill building, and receptive and expressive language skill building. In a broader sense, it serves as a conduit for achieving diverse rehab goals across many disabilities, age groups and settings. The advantage to playing a client centered game is the increased repetitions of a desired therapeutic intervention and time needed to complete a game. Some examples of how the present invention helps handicapped individuals are: (1) to increased sitting/standing balance for high fall risk geriatric populations, cerebral palsy, vestibular impaired, and vision impaired clients; (2) to increase transfer skills (sit to stand) and change of direction skills; (3) increased hand coordination with various sizes of playing pieces—using intrinsic or extrinsic muscles and different fingers with thumb; and (4) increased functional vision, especially when using a larger game board or playing surface.

Throughout the specification the aim has been to describe the invention without limiting the invention to any one embodiment or specific collection of features. Persons skilled in the relevant art may realize variations from the specific embodiment that will nonetheless fall within the scope of the invention. For example, the words "magnetic" and "magnet attractant" may be used interchangeably through out this speciation and claims. The magnet attractant dry erase board can be attached to any type of support, and can be fixed in any angle. The game board can be made from any thin material that allows for the game piece to attach to the magnet attractant dry erase board. The game board can be attached to the magnet attractant dry erase board in any means including hooks, magnets and tape. The game piece may be made of other material as long its functional utility is not impaired. The magnet can be of various types. The cap can be screwed on or plugged into the transparent hollow body or can be permanently fixed. The game piece may also be played with an "open top" to allow handicapped people with gross finger flexion and no thumb function to manipulate the playing piece with access to the internal cavity. Lastly, the sizes of the magnet attractant dry erase board, the game pieces and the game board are not limited to those disclosed in the preferred embodiment.

Accordingly, the scope of the invention should be determined not by the embodiment illustrated, but by the appended claims and their legal equivalents.

I claim:

1. A therapy board game assembly used to provide therapeutic stimulation to impaired and handicapped individuals comprising:

a. A magnet attractant dry erase board with the ability to be placed in a substantially vertical position and to be used as a means to support a game board and an at least one elongated magnetic game piece;

b. the said game board having a means of attachment to the said magnet attractant dry erase board;

c. the said an at least one elongated magnetic game piece further comprising of a hollow substantially elongated transparent body with a topside and a bottom side; a magnet connected to the said bottom side of said hollow substantially transparent body and a removable cap connected to the said topside of the said hollow substantially transparent body; and a rolled image paper inserted and visible within the said hollow substantially transparent body.

2. The therapy board game assembly of claim 1 further comprising of a pickup stick comprising of a rod with a magnetic tip used to pickup fallen game pieces.

3. The therapy board game assembly of claim 1 wherein the said hollow substantially elongated transparent body of the said game piece is cylindrical in shape.

4. The therapy board game assembly of claim 1 wherein the said hollow substantially transparent elongated body of the said game piece is conical in shape.

5. The therapy board game assembly of claim 1 further comprising a game piece cap cover connectable to the said removable cap of the said game piece using a magnetic attachment means thus allowing the said removable cap to identify individual games pieces comprising of checkered pieces and chess pieces.

6. The therapy board game assembly of claim 1 wherein the said removable cap and said hollow substantially transparent body are made of plastic.

7. The therapy board game assembly of claim 1 further containing an at least one card piece, wherein the said card piece is affixed to a magnet and capable of being placed on the said magnet attractant dry erase board.

8. The therapy board game assembly of claim 1 further containing an at least one domino piece, wherein the said domino piece is affixed to a magnet and capable of being placed on the said magnet attractant dry erase board.

9. The therapy board game assembly of claim 1 further comprising an at least one tracing sheet capable of being placed on the said magnet attractant dry erase board.

10. The therapy board game assembly of claim 9 wherein the said tracing sheet is made of a lexan material.

11. The therapy board game assembly of claim 1 wherein the said magnetic attractant dry erase board is supported by an adjustable stand wherein the said adjustable stand can be adjustable in height and in angle.

12. The therapy board game assembly of claim 11 wherein the said adjustable stand contains an at least one storage shelf.

13. The therapy board game assembly of claim 1 wherein the said rolled image paper portrays at least one motivational message.

* * * * *